US005221603A

United States Patent [19]

Yoneyama et al.

[11] Patent Number: 5,221,603

[45] Date of Patent: Jun. 22, 1993

[54] SILVER HALIDE PHOTOGRAPHIC MATERIAL

[75] Inventors: Masakazu Yoneyama; Tomokazu Yasuda; Yasushi Suga, all of Kanagawa, Japan

[73] Assignee: Fuji Photo Film Co., Ltd., Kanagawa, Japan

[21] Appl. No.: 754,845

[22] Filed: Sep. 4, 1991

[30] Foreign Application Priority Data

Sep. 4, 1990 [JP] Japan ..... 2-233699

[51] Int. Cl.[5] ..... G03C 1/38

[52] U.S. Cl. ..... 430/634; 430/631; 430/636; 430/642; 430/643

[58] Field of Search ..... 430/634, 631, 636, 642, 430/643; 252/332, 351, 353

[56] References Cited

U.S. PATENT DOCUMENTS 3,619,199 11/1971 Mackey .
4,766,061 8/1988 Simmons .

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material comprising a support having thereon at least one light-sensitive silver halide emulsion layer, wherein the silver halide emulsion layer or another hydrophilic colloid layer contains a compound represented by the following general formula (I):

(I)

wherein $R_1$ and $R_2$ each represents a hydrogen atom or a substituted or unsubstituted hydrocarbon group having 1 to 30 carbon atoms, and at least one of $R_1$ and $R_2$ represents a substituted or unsubstituted hydrocarbon group, including an alkyl group having not less than 6 carbon atoms; L represents a divalent bonding group; and M represents a hydrogen atom or a cation.

8 Claims, No Drawings

SILVER HALIDE PHOTOGRAPHIC MATERIAL

FIELD OF THE INVENTION

The present invention relates to a silver halide photographic material having a hydrophilic organic colloid-coated layer containing a novel coating aid. More particularly, it relates to a silver halide photographic material containing a specific surfactant which enables a uniform coating film to be coated and formed at a high speed without causing repellent spots, unevenness, or other common problems.

BACKGROUND OF THE INVENTION

It is well known that a plurality of layers comprising a hydrophilic organic colloid (generally gelatin) may be provided on a support such as cellulose triacetate, polyethylene terephthalate or paper. These layers have various functions, for instance as a underlayer, interlayer, light-sensitive layer, protective layer, etc. Each layer contains various organic or inorganic additives to fulfill its function.

Generally, a photographic material comprises many hydrophilic organic colloid layers as mentioned above. In the preparation thereof, it is required that the coating solutions for these layers be uniformly coated in the form of a thin film at a high speed without causing any troubles in coating such as comet, repellent spots, and unevenness in coating. Continuous multi-layer co-coating methods have been carried out in recent years.

Coating steps in the preparation of color photographic materials are often difficult to perform. In the preparation of the color photographic materials, difficultly water-soluble additives such as color couplers, ultraviolet ray absorbers, brightening agents, etc., are dissolved in a high-boiling organic solvent such as a phthalic ester or a phosphoric ester and a co-solvent such as ethyl acetate. The resulting solution is dispersed (so-called emulsification) in a solution of a hydrophilic organic colloid, particularly gelatin, in the presence of a surfactant. The resulting emulsified dispersion is contained in a hydrophilic organic colloid layer.

When a large amount of a surfactant is used as the emulsifying agent for the formation of the above-described emulsified dispersion, it is difficult to coat a subsequent hydrophilic organic colloid layer on the previously coated hydrophilic organic colloid layer. On the other hand, when the amount of the emulsifying agent is reduced, the emulsion particles agglomerate, and the photographic characteristics of the coated photographic material are unstable.

One of the coating steps which is particularly difficult is the curtain coating method wherein a coating is carried out by forcing a coating solution in the form of a thin film to collide with a support described in JP-B-49-24133 (the term "JP-B" as used herein means "examined Japanese Patent publication") and JP-B-49-35447.

The most important question in the curtain coating method is how to coat rapidly and stably a coating solution in the form of a film. Many attempts and improvements have been made. Most of them have been directed to improvements in the devices for use in the coating step. It has been found that completely satisfactory results can not be obtained by these improvements in the devices, and the results greatly depend on the physical properties of the coating solution.

Various anionic surfactants have been conventionally examined as coating aids for various coating solutions for photographic materials. Concrete examples of the anionic surfactants are disclosed in U.S. Pat. Nos. 2,240,476, 3,026,202, 3,068,101, 3,320,847, 3,415,649 and 4,916,054, West German Patent 1,942,665, JP-B-59-50969, JP-A-2-178649 and JP-A-2-178648 (the term "JP-A" as used herein means an "unexamined published Japanese patent application").

However, most of these anionic surfactants do not provide satisfactory wetting, repellent spot inhibition and curtain coatability (thin film formation) in high-speed coating systems, which qualities have been particularly demanded in recent years.

SUMMARY OF THE INVENTION

An object of the present invention is to provide a method which enables one to coat photographic emulsions or other hydrophilic colloid compositions at a high speed without causing repellent spots and other problems in the coating.

Another object of the present invention is to provide a method which enables one to coat at a high speed and to form stable thin films by a curtain coating method.

Still another object of the present invention is to provide a photographic material which cause neither staining of the developing solutions nor staining of the rollers of the processors.

These and other objects of the present invention have been achieved by a silver halide photographic material comprising a support having thereon at least one light-sensitive silver halide emulsion layer, wherein the silver halide emulsion layer or another hydrophilic colloid layer contains a compound represented by the following general formula (I):

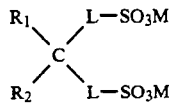

(I)

wherein $R_1$ and $R_2$ each represents a hydrogen atom or a substituted or unsubstituted hydrocarbon group having 1 to 30 carbon atoms, and at least one of $R_1$ and $R_2$ represents a substituted or unsubstituted hydrocarbon group, including an alkyl group having not less than 6 carbon atoms; L represents a divalent bonding group; and M represents a hydrogen atom or a cation.

DETAILED DESCRIPTION OF THE INVENTION

The present invention will be illustrated in more detail below.

In general formula (I), it is particularly preferred that $R_1$ and $R_2$ each separately represents an alkyl group having 6 to 10 carbon atoms which may be a straight-chain or branched alkyl group. Preferably, the divalent bonding group represented by L is

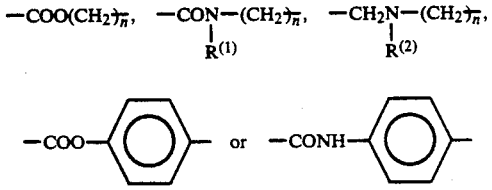

and particularly preferably, L is a group of $$-CON(R^{(1)})-(CH_2)_n \quad \text{or} \quad -CH_2N(R^{(2)})-(CH_2)_n$$

wherein $R^{(1)}$ represents a hydrogen atom or an alkyl group having 1 to 6 carbon atoms; $R^{(2)}$ represents a hydrogen atom, an alkyl group having 1 to 6 carbon atoms or an acyl group; and n represents an integer of 1 to 6. Examples of the cation represented by M include alkali metals, alkaline earth metals and lower ammonium salts.

Among them, compounds represented by the following general formulas (II) and (III) are particularly preferred:

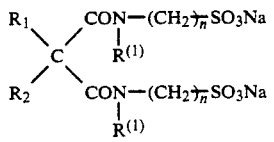

(II)

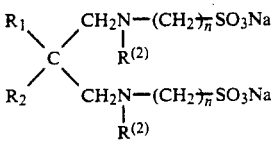

(III)

wherein $R_1$ and $R_2$ are each separately an alkyl group having 6 to 10 carbon atoms; and $R^{(1)}$, $R^{(2)}$ and n are as defined above.

Preferred examples of the compounds of general formula (I) which are used in the present invention include, but are not limited to, the following compounds:

1. 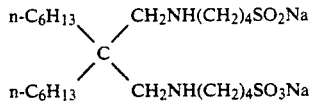

2. 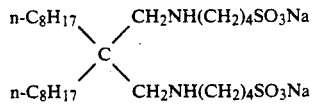

3. 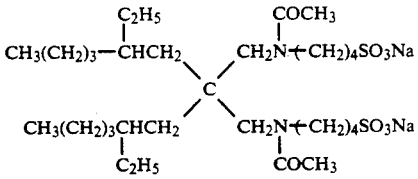

4. 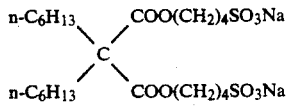

5. 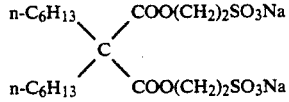

6. 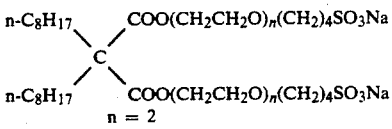

n = 2

-continued

7. 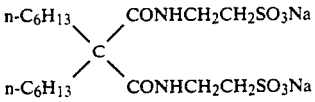

8. 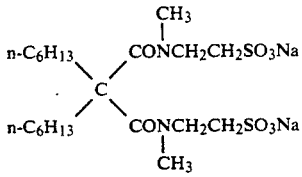

9. 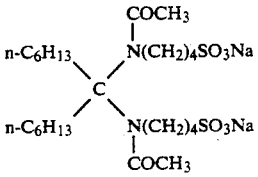

10. 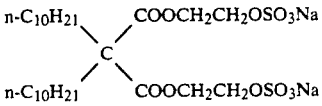

11. 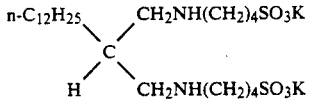

12. 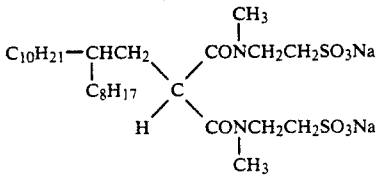

13. 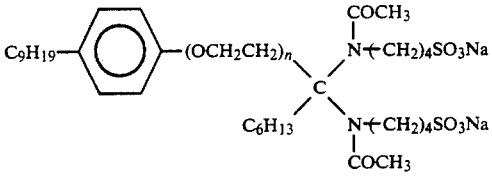

14. 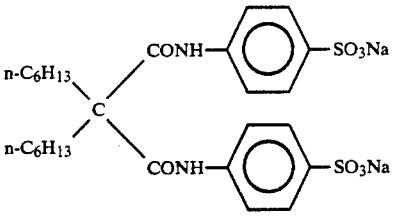

15. 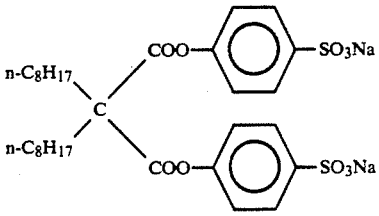

-continued

16.

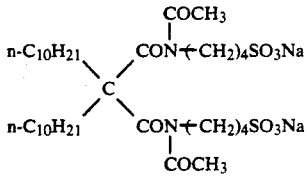

These compounds of general formula (I) can be synthesized according to the methods described in *J. Org. Chem.*, 26, 4112 (1961), and U.S. Pat. Nos. 2,662,073 and 4,892,806. A typical example of the synthesis methods is illustrated below.

SYNTHESIS EXAMPLE (SYNTHESIS OF COMPOUND 1)

(A) Synthesis of 2,2-dihexylpropanedinitrile

To a slurry of sodium hydride (2.0 mol) in 800 mol of dry DMSO, there was slowly added 66.1 g (1.0 mol) of malononitrile dissolved in 200 mol of dry DMSO, under stirring and cooling with water. After completion of the addition, stirring was continued for 20 minutes, and 330.1 g (2.0 mol) of hexyl bromide was then added dropwise thereto under cooling with ice (20° C., one hour).

After completion of the addition, stirring was continued, first at 30° C. or below for 2 hours and then at 50° C. for 4 hours. The reaction mixture (solution) was poured into 3000 ml of ice water. Two thousand ml of ethyl acetate was added thereto to extract an oily component. The ethyl acetate layer was washed with water twice and dried over anhydrous magnesium sulfate. Ethyl acetate was distilled off to obtain a yellow oily material. The oily material was distilled under reduced pressure to obtain 181 g of the desired product as a colorless oil (boiling point: 153° to 159° C./6 mmHg).

(B) Synthesis of 2,2-dihexylpropane-1,3-diamine 180.5 g (0.77 mol) of 2,2-dihexylpropanedinitrile was dissolved in 320 ml of ethanol. About 5 g of Raney nickel (dispersion in toluene) was added thereto, and the dinitrile was catalytically reduced at 100° C. under hydrogen pressure of 100 kg/m$^2$ in an autoclave for 6 hours. The catalyst was removed, and ethanol was distilled off to obtain an oily material. The oily material was distilled under reduced pressure to obtain 119 g of the desired product as a colorless oil (boiling point: 153° to 160° C./4 mmHg).

(C) Synthesis of 2,2-dihexyl-1,3-bis(1-aminobutanesulfonate (Na)) (Compound-1)

24.2 g (0.1 mol) of 2,2-dihexyl-1,3-diamine was dissolved in 120 ml of toluene, and 27.2 g (0.2 mol) of butanesultone was added dropwise thereto at 60° C., under stirring. Stirring was continued first at 60° C. for one hour and then at 110° C. for two hours. The temperature of the reaction mixture was lowered to 50° C., and 38.6 g of a methanol solution (28%) of 10.8 g of sodium methoxide was added thereto. The mixture was stirred for 30 minutes, and 800 ml of methanol and 100 ml of ethanol were added thereto. The mixture was heated to dissolve soluble matters, and insoluble matters were removed by filtration. The solvents were distilled off to concentrate the mixture, and about 800 ml of acetonitrile was added to crystallize the product. There was obtained 31 g of the desired product.

Other compounds of general formula (I) which are used in the present invention can be synthesized in the same manner as shown by the Synthesis Example above.

For example, when the divalent bonding group represented by L in general formula (I) is

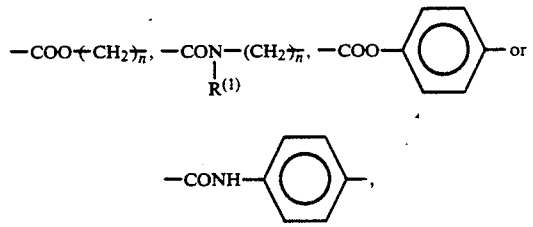

malonic acid, methyl malonate or malonyl chloride is used in place of malononitrile. It is reacted with an alkanesultone, taurine, isethionic acid, aminobenzenesulfonic acid and hydroxybenzenesulfonic acid in the same manner as described above to prepare the corresponding compounds.

Those compounds having sulfonic acid groups or sulfuric acid ester groups represented by general formula (I) (anionic surfactants) according to the present invention exhibited a remarkably excellent coating effect when they were added to hydrophilic organic colloid coating solutions.

Namely, it has been found that multi-layer co-coating (simultaneous coating) can be uniformly conducted at a high speed without causing repellent spots or unevenness. Further, thin films can be stably formed, and coating can be carried out at a high speed in the curtain coating system.

It has also been found that photographic materials containing the compounds of the present invention are characterized by an absence of staining material in the developing solutions. It is thought that the reason the compounds of the present invention exhibit these excellent characteristics is that the compounds have two sulfo groups per molecule and these characteristics are the result of an interaction between these hydrophilic groups and of the surface active behavior due to the specific chemical structure of the compounds of the present invention. The compounds of the present invention have such physical properties that critical micelle concentration (cmc) and surface tension (dynamic and static) are remarkably low, Kraft point is low, and solubility is high.

In the present invention, the compounds of general formula (I) as coating aids are added to hydrophilic organic colloid coating solutions. The compounds are used in an amount of 0.01 to 50 g, preferably 0.05 to 5 g per kg of the coating solution.

Preferably, the compounds are added as a solution thereof dissolved in water, methanol or a water-miscible solvent.

These surfactants may be added to any coating solutions which are used in the formation of photographic layers which constitute the photographic material. The layers to which the compound is added may be any of light-sensitive layers or light-insensitive layers.

When the compounds of general formula (I) are added, extremely uniform coating films of hydrophilic colloid can be formed by low-speed coating as well as by high-speed coating in the preparation of the photographic materials of the present invention. Namely, unevenness in coating is not caused, and comet and repellent spots are not formed.

The compounds of the present invention are particularly useful as coating aids when lipophilic materials such as couplers, alkylhydroquinones, ultraviolet ray absorbers, sensitizing dyes and hydrophobic vinyl polymers are contained in the photographic materials.

Namely, a solution of these lipophilic materials dissolved in a high-boiling difficultly water-soluble organic solvent is finely stably dispersed in an aqueous solution of hydrophilic colloid in the presence of the surfactant represented by the above-described general formula. The solution is used directly as a coating solution or is further added to coating solutions for photographic emulsions, etc.

Further, the compounds of the present invention are effective in the preparation of the aqueous dispersions of the hydrophobic vinyl polymers. Namely, hydrophobic vinyl monomers are emulsified in an aqueous solution containing the surfactant of the present invention, a polymerization initiator is added thereto and a polymerization reaction is carried out to obtain thereby a stable aqueous dispersion having a fine particle size.

Gelatin can be advantageously used as hydrophilic organic colloid in the present invention. In addition to gelatin, other hydrophilic colloid can be used. Examples of suitable hydrophilic colloids include protein such as gelatin derivatives, graft polymers of gelatin with other high-molecular materials, albumin and casein; cellulose derivatives such as hydroxyethyl cellulose, carboxymethyl cellulose and cellulose sulfate; saccharose derivatives such as sodium alginate and starch derivatives; and various synthetic hydrophilic high-molecular materials such as homopolymers, for example, polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole and copolymers thereof.

Examples of the gelatin include lime-processed gelatin, acid-processed gelatin, enzyme-processed gelatin [described in *Bull. Soc. Sci. Phot. Japan*, No. 16, page 30. (1966)] and hydrolyzates and enzymatic decomposate of gelatin. Examples of the gelatin derivatives which can be used include reaction products obtained by reacting gelatin with a compound such as an acid halide, an acid anhydride, an isocyanate, bromoacetic acid, an alkanesultone, a vinylsulfonamide, a maleinimide compound, a polyalkylene oxide or an epoxy compound.

The term "hydrophilic organic colloid layer" as used herein refers to photographic coating layers using the above-described hydrophilic organic colloid, particularly gelatin, as a binder. Examples of such photographic coating layers include silver halide emulsion layers, surface protective layers, filter layers, interlayers, antihalation layers, antistatic layers, underlayers and backing layers.

The compounds of the present invention have a high solubilizing power and a high surface activity so that they can be preferably used in the coating of the hydrophilic organic colloid layers in which the difficultly water-soluble photographic additives are dissolved or dispersed by using the high-boiling organic solvents.

Various silver halides can be used in the silver halide emulsion layers of the present invention. Examples of suitable silver halides include silver chloride, silver bromide, silver chlorobromide, silver iodobromide and silver chloroiodobromide. Silver iodobromide having a silver iodide content of 2 to 20 mol % and silver chlorobromide having a silver bromide content of 10 to 50 mol % are preferred. Any silver halide grains can be used without any particular limitation with regard to crystal form, crystal structure, grain size, grain size distribution, etc. The crystal form of silver halide may be a normal crystal form or a twin form, and the crystal may be hexahedron, octahedron or tetradecahedron. Silver halide grains may be tabular grains having a thickness of 0.05 to 0.5 μm, a grain size of 0.6 to 10 μm and an aspect ratio of not lower than 5 as described in *Research Disclosure* 22534 (January 1983).

The crystal structure may be uniform, or may have a composition so that the interior of the grain and the surface layer thereof are different in halogen composition from each other. The crystal structure may be a laminar structure or may have a structure so that silver halide grains having different compositions are bonded to each other by epitaxial growth. Further, a mixture of grains having various crystal forms may be used. Furthermore, there can be used grains wherein a latent image is predominantly formed on the surface of the grain, or grains wherein a latent image is predominantly formed in the interior of the grain.

With regard to grain size, grains which can be used range from fine grains having a grain size of not larger than 0.1 μm to large-size grains having a grain size of 3 μm, based on the project area of the grain. Any monodisperse emulsion having a narrow grain size distribution or polydisperse emulsion having a wide grain size distribution can be used.

These silver halide grains can be prepared by known methods conventionally used in the art.

The silver halide emulsions can be sensitized by conventional chemical sensitization such as sulfur sensitization, noble metal sensitization or a combination thereof. Further, color sensitivity in a desired light-sensitive wavelength region can be imparted to the silver halide emulsions of the present invention by using sensitizing dyes. Examples of the dyes which can be advantageously used in the present invention include methine dyes such as cyanine dyes, hemicyanine dyes, rhodacyanine dyes, merocyanine dyes, oxonol dyes and hemioxonol dyes and styryl dyes. These dyes may be used either alone or a combination of two or more.

Examples of the difficultly water-soluble photographic additives which can be used in the present invention include oil-soluble color couplers, anti-oxidants for use in preventing color fogging or color mixing from being caused, anti-fading agents (e.g., alkylhydroquinones, alkylphenols, chromans, coumarones, etc.), hardening agents, oil-soluble filter dyes, oil-soluble ultraviolet ray absorbers, DIR compounds (e.g., DIR hydroquinones, non-color forming DIR compounds, etc.), developing agents, dye developing agents, DRR compounds, DDR couplers, etc.

Examples of the oil-soluble color couplers which can be used in the present invention include benzoylacetanilide compounds, pivaloylacetanilide compounds, pyrazolone compounds, cyanoacetyl compounds, phenol compounds and naphthol compounds. Typical examples of these couplers are described in U.S. Pat. Nos. 2,875,057, 3,408,194, 3,582,322, 3,891,445, 2,600,788, 3,062,653, 3,311,476, 3,519,429, 3,558,319, 3,615,506, 3,834,908, 2,369,929, 2,474,293, 2,895,826, 3,591,383, 3,227,544 and 3,790,384.

Examples of high-boiling organic solvents which can be used in the present invention include alkyl phthalates (e.g., dibutyl phthalate, dioctyl phthalate, etc.), phosphoric esters (e.g., diphenyl phosphate, triphenyl phosphate, tricresyl phosphate, dioctyl butyl phosphate), citric esters (e.g., tributyl acetylcitrate), benzoic esters (e.g., octyl benzoate) and alkylamides (e.g., diethyllaurylamide).

The hydrophilic organic colloid layer according to the present invention, in particular a surface protective layer preferably contains an antistatic agent. Examples of the antistatic agents include a fluorinated cationic surfactant as described in JP-B-48-43130, and U.S. Pat. Nos. 3,775,126, and 4,407,937 (such as $C_8F_{17}SO_2NH(CH_2)_3N^{\oplus}(CH_3)_3I^{\ominus}$, $C_8F_{17}SO_2NH(CH_2)_3N^{\oplus}(CH_3)_3$

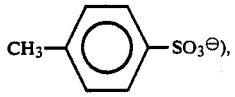

a fluorinated anionic, cationic, nonionic or amphoteric surfactant as described in U.S. Pat. Nos. 3,666,478 and 4,272,615 (such as $$C_8F_{17}SO_2\underset{\underset{C_3H_7}{|}}{N}CH_2COOK),$$

a nonionic surfactant as described in JP-A-60-76742, JP-A-60-80846, JP-A-60-80848, JP-A-60-80839, JP-A-60-76741, JP-A-58-208743, Japanese Patent Application Nos. 61-13398, 61-16056 and 61-32462 (corresponding to JP-A-62-172343, JP-A-62-173459 and JP-A-62-215272, respectively) and an electric conductive (nonionic, anionic, cationic or amphoteric) polymer or latex as described in JP-A-57-204540 and Japanese Patent Application No. 61-32462. Examples of inorganic antistatic agents include a halide, nitrate, perchlorate, sulfate, acetate, phosphate or thiocyanate of ammonium, an alkali metal or an alkaline earth metal, and an electric conductive tin oxide or zinc oxide or a complex oxide obtained by doping antimony, etc. in the oxide as described in JP-A-57-118242.

In addition thereto, the hydrophilic colloid coating solutions of the present invention may contain various additives such as stabilizers, hardening agents, dyes, matting agents, light-sensitive silver halide grains, other surfactants and polymer latex and brightening agents, these additives being useful for the photographic materials.

Other surfactants described above which can be used in combination with the surfactants of the present invention are preferably nonionic surfactants.

The above-described additives are described in *Product Licensing Index*, Vol. 92, pp. 107 to 110 (December 1971), *Research Disclosure* 15162 (November 1976) and ibid., 17643 (December 1978).

When the hydrophilic organic colloid coating layers containing the compounds of the present invention contain a silver halide emulsion, the relation of the coating layers to silver halide emulsion layers may be water-permeable, or said relation may be water-impermeable as in the relation of backing layer to the silver halide emulsion layers. Further, the present invention is applicable to the coating of a single layer or to multi-layer co-coating, the layer or layers containing no silver halide emulsion layer. When multi-layer co-coating is to be conducted, the compounds of the present invention may be contained in all of the coating solutions. However, when the compounds of the present invention are added to the uppermost layer from the support (e.g., a protective layer) or an adjacent layer thereto, the improvement in the coating and an improvement in coating rate are remarkable. The formation of repellent spots in coating can be reduced even further when a coating layer which does not contain the compounds of the present invention is provided on a coating layer containing the compounds of the present invention which is cooled and set.

Multi-layer co-coating can be carried out by hopper coating described in U.S. Pat. No. 2,761,417, curtain coating described in U.S. Pat. No. 3,508,947 and coating methods described in *Research Disclosure* 17644 (December 1978).

The present invention is now illustrated in greater detail by reference to the following examples which, however, are not to be construed as limiting the invention in any way.

EXAMPLE 1

One kilogram of a silver chlorobromide emulsion (containing 100 g of gelatin per mol of silver halide) prepared by forming grains and conducting ripening in a conventional manner was diluted with a 10% aqueous gelatin solution to three times. Two g of saponin per one kg of the resulting emulsion solution was added to the emulsion solution. Separately, a 5% aqueous gelatin solution was prepared, and an emulsion (average grain size: 0.9 μm) obtained by dispersing tri-n-hexyl phosphate in gelatin was added thereto in such an amount as to give a solution containing 18 ml of tri-n-hexyl phosphate per kg of the 5% aqueous gelatin solution. The resulting solution was equally divided into 10 portions. A coating aid was added to each portion in such an amount as to give a coating solution containing 2.0 g of coating aid per kg of coating solution, thus preparing the coating solution for a surface protective layer.

The surface tension of each coating solution for the surface protective layer was measured by Wilhelmy's surface balance (see, E. Matijevic, *Surface and Colloid Science*, Vol. 1, PP. 124 to 128 (Wiley Interscience 1969)).

The above-described emulsion solution and the coating solution for surface protective layer were coated on an undercoated cellulose triacetate support at a coating rate of 100 m/min by means of a two layer co-coating method using a multi-slide hopper type coating equipment to prepare each of Samples (1) to (10). The number of repellent spots per $m^2$ of each sample was examined. The degree of staining of roller was evaluated in the following manner. The results are shown in Table 1.

Measurement of the Degree of Staining of Roller

Each sample having the emulsion layer and the surface protective layer coated thereon was cut into specimens having a size of 30.5 cm×17.1 cm. The sample was uniformly exposed so as to give an optical density of 1.0 after development, and 50 sheets of the specimens of the sample was continuously developed by an automatic processor (provided with a silicone roller conveyor; developing solution=RD-II manufactured by Fuji Photo Film Co, Ltd., 35° C.; fixing bath=Fuji-F manufactured by Fuji Photo Film Co., Ltd., 35° C.; rinse bath being composed of three baths).

The sample was washed with water, passed through squeegee rollers and thoroughly dried. The degree of streaky unevenness in the density formed on the tip of the 51st specimen of the specimens of the sample was examined.

The evaluation of the degree of the staining of roller was made in the following 4 grades. (Unevenness in density was increased with an increase in the degree of staining.)

A: The formation of unevenness in density was not found.

B: The formation of unevenness in density was slightly found.

C: The formation of unevenness in density was considerably found.

D: The formation of unevenness in density was remarkably found.

TABLE 1

| Sample No. | Coating aid for surface protective layer | Surface tension of surface protective layer | Number of repellent spots | Degree of staining of roller (unevenness in processing) |
|---|---|---|---|---|
| 1 | Comparative compound A | 30.3 dyn/cm | 138 $m^2$ | C |
| 2 | Comparative compound B | 29.5 | 65 | D |
| 3 | Comparative compound C | 33.0 | 15 | A, B |
| 4 | Compound 1 | 28.0 | 2 | A |
| 5 | Compound 2 | 27.0 | 3 | A |
| 6 | Compound 3 | 26.5 | 1 | A |
| 7 | Compound 4 | 28.5 | 2 | A |
| 8 | Compound 8 | 27.0 | 3 | A |
| 9 | Compound 9 | 27.5 | 3 | A |
| 10 | Compound 16 | 26.0 | 5 | B |

Comparative Compound A:

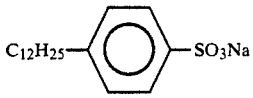

Comparative Compound B:

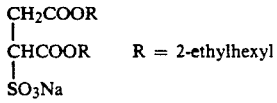

Comparative Compound C

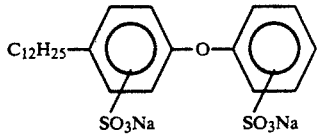

It is apparent from Table 1 that Samples 4 to 10 prepared by using the compounds of the present invention give such excellent results that the number of repellent spots is small and the degree of the staining of roller is low.

EXAMPLE 2

A coating solution for a surface protective layer was prepared by adding 0.6 g of polypotassium vinylbenzenesulfonate and 2.0 g of coating aid to one kg of a 7% aqueous gelatin solution.

A curtain film was formed from the coating solution by using an extrusion type curtain coater as described in JP-A-55-73365. The minimum flow rate (Q) capable of forming a film was measured.

Further, the above-described coating solution was coated on a polyethylene terephthalate film by using the curtain coater to examine the critical coating speed. The results are shown in Table 2.

TABLE 2

| Sample No. | Coating aid for surface protective layer | Q* (cc/cm · sec) | Critical speed** |
|---|---|---|---|
| 11 | Comparative compound A | 2.0 | 300 |
| 12 | Comparative compound D | 2.5 | 260 |
| 13 | Comparative compound E | 2.3 | 300 |
| 14 | Compound 1 | 0.8 | 340 |
| 15 | Compound 3 | 0.7 | 350 |
| 16 | Compound 9 | 0.9 | 340 |

*Q: The minimum flow rate required for forming a curtain film (50 mm in height)/unit width and unit time.

**Critical speed: Critical speed at which normal coating for forming a curtain film (50 mm in height) can not be made by air entrainment, etc., under conditions of Q = 3.0 cc/cm · sec.

Comparative Compound A:

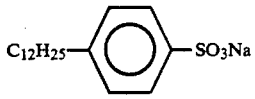

Comparative Compound D:

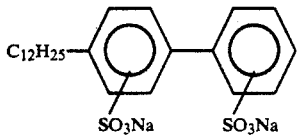

Comparative Compound E:

$C_{16}H_{33}O(CH_2CH_2O)_{10}H$

As shown in Table 2, the Q values of Comparative Samples 11, 12 and 13 are 2.0, 2.5 and 2.3, respectively, while the Q values of Samples 14, 15 and 16 of the present invention are 0.8, 0.7 and 0.9, respectively.

It will be understood that though the Q values of the sample of the present invention are small, a curtain film can be formed and the compounds of the present invention are effective in forming a thin curtain film.

EXAMPLE 3

An undercoated cellulose triacetate film support was coated with the following layers having the following compositions to prepare a multi-layer color photographic material.

Composition of Light-Sensitive Layer

The amounts of silver halide and colloidal silver are represented by coating weight ($g/m^2$), in terms of silver. The amounts of couplers, additives and gelatin are represented by coating weight ($g/m^2$). The amounts of sensitizing dyes are represented by moles per one mole of silver halide in the same layer.

| | |
|---|---|
| First layer (antihalation layer) | |
| Black colloidal silver | 0.5 |
| Gelatin | 1.3 |
| Colored coupler C-1 | 0.06 |
| Ultraviolet ray absorber UV-1 | 0.1 |
| Ultraviolet ray absorber UV-2 | 0.2 |
| Dispersion oil Oil-1 | 0.01 |
| Dispersion oil Oil-2 | 0.01 |
| Desilverization accelerator BA-1 | 0.03 |
| Surfactant SA-2 | 0.01 |
| Second layer (interlayer) | |
| Fine silver bromide grains (mean grain size: 0.07 μm) | 0.15 |
| Gelatin | 1.0 |
| Colored coupler C-2 | 0.02 |
| Dispersion oil Oil-1 | 0.1 |
| Surfactant SA-2 | 0.01 |
| Third layer (first red-sensitive emulsion layer) | |
| Silver iodobromide emulsion (silver iodide content: 2 mol %, mean grain size: 0.3 μm) | 0.4 as silver |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-4}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |
| Surfactant SA-1 | 0.02 |
| Fourth layer (second red-sensitive emulsion layer) | |
| Silver iodobromide emulsion (silver iodide content: 5 mol %, mean grain size: 0.5 μm) | 0.7 as silver |
| Gelatin | 2.5 |
| Sensitizing dye I | $1 \times 10^{-4}$ |
| Sensitizing dye II | $3 \times 10^{-4}$ |
| Sensitizing dye III | $1 \times 10^{-4}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |
| Surfactant SA-1 | 0.05 |
| Fifth layer (third red-sensitive emulsion layer) | |
| Silver iodobromide emulsion (silver iodide content: 10 mol %, mean grain size: 0.7 μm) | 1.0 as silver |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-4}$ |
| Coupler C-6 | 0.05 |
| Coupler C-7 | 0.1 |
| Dispersion oil Oil-1 | 0.01 |
| Dispersion oil Oil-2 | 0.05 |
| Surfactant SA-1 | 0.01 |
| Sixth layer (interlayer) | |
| Gelatin | 1.0 |
| Compound Cpd-A | 0.03 |
| Dispersion oil Oil-1 | 0.05 |
| Surfactant SA-2 | 0.02 |
| Seventh layer (first green-sensitive emulsion layer) | |
| Silver iodobromide emulsion (silver iodide content: 4 mol %, mean grain size: 0.3 μm) | 0.30 as silver |
| Sensitizing dye IV | $5 \times 10^{-4}$ |
| Sensitizing dye VI | $0.3 \times 10^{-4}$ |
| Sensitizing dye V | $2 \times 10^{-4}$ |
| Gelatin | 1.0 |
| Coupler C-9 | 0.28 |
| Coupler C-5 | 0.03 |
| Coupler C-1 | 0.03 |
| Dispersion oil Oil-1 | 0.5 |
| Surfactant SA-1 | 0.04 |
| Eighth layer (second green-sensitive emulsion layer) | |
| Silver iodobromide emulsion (silver iodide content: 5 mol %, mean grain size: 0.5 μm) | 0.4 as silver |
| Gelatin | 0.8 |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersion oil Oil-1 | 0.2 |
| Surfactant SA-1 | 0.01 |
| Ninth layer (third green-sensitive emulsion layer) | |
| Silver iodobromide emulsion (silver iodide content: 6 mol %, mean grain size: 0.7 μm) | 0.85 as silver |
| Gelatin | 1.0 |
| Sensitizing dye VII | $3.5 \times 10^{-4}$ |
| Sensitizing dye VIII | $1.4 \times 10^{-4}$ |
| Coupler C-11 | 0.01 |
| Coupler C-12 | 0.03 |
| Coupler C-13 | 0.24 |
| Coupler C-1 | 0.02 |
| Coupler C-15 | 0.02 |
| Dispersion oil Oil-1 | 0.24 |
| Dispersion oil Oil-2 | 0.05 |
| Surfactant SA-1 | 0.03 |
| Tenth layer (yellow filter layer) | |
| Gelatin | 1.2 |
| Yellow colloidal silver | 0.08 |
| Compound Cpd-B | 0.1 |
| Dispersion oil Oil-1 | 0.3 |
| Surfactant SA-2 | 0.04 |
| Eleventh layer (first blue-sensitive emulsion layer) | |
| Monodisperse silver iodobromide emulsion (silver iodide content: 4 mol %, means grain size: 0.3 μm) | 0.4 as silver |
| Gelatin | 1.0 |
| Sensitizing dye IX | $2 \times 10^{-4}$ |
| Coupler C-14 | 0.09 |
| Coupler C-5 | 0.07 |
| Dispersion oil Oil-1 | 0.2 |
| Surfactant SA-1 | 0.04 |
| Twelfth layer (second blue-sensitive emulsion layer) | |
| Silver iodobromide emulsion (silver iodide content: 10 mol %, mean grain size: 1.5 μm) | 0.5 as silver |
| Gelatin | 0.6 |
| Sensitizing dye IX | $1 \times 10^{-4}$ |
| Coupler C-14 | 0.25 |

-continued

| | |
|---|---|
| Dispersion oil Oil-1 | 0.07 |
| Surfactant SA-1 | 0.03 |
| Thirteenth layer (first protective layer) | |
| Gelatin | 0.8 |
| Ultraviolet ray absorber UV-1 | 0.1 |
| Ultraviolet ray absorber UV-2 | 0.2 |
| Dispersion oil Oil-1 | 0.01 |
| Dispersion oil Oil-2 | 0.01 |
| Surfactant SA-3 | 0.04 |
| Fourteenth layer (second protective layer) | |
| Fine silver bromide grains (mean grain size: 0.07 μm) | 0.5 as silver |
| Gelatin | 0.45 |
| Polymethyl methacrylate particles (diameter: 1.5 μm) | 0.2 |
| Hardening agent H-1 | 0.4 |
| Formaldehyde scavenger S-1 | 0.5 |
| Formaldehyde scavenger S-2 | 0.5 |
| Surfactant SA-4 | 0.01 |
| Surfactant SA-5 | 0.05 |
| Surfactant SA-6 (antistatic agent) | 0.02 |

The thus-prepared sample was referred to as Sample 301.

The chemical structural formulas and chemical names of the compounds used above in the present invention are as follows:

UV-1

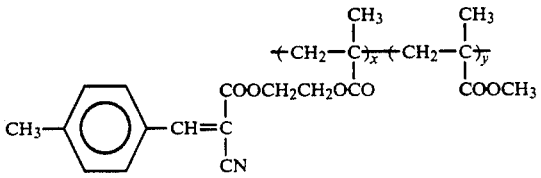

x/y = 7/3 (by weight)

BA-1

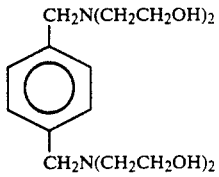

UV-2

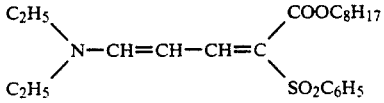

Tricresyl phosphate — Oil-1

Dibutyl phthalate — Oil-2

Bis(2-ethylhexyl) phthalate — Oil-3

C-1

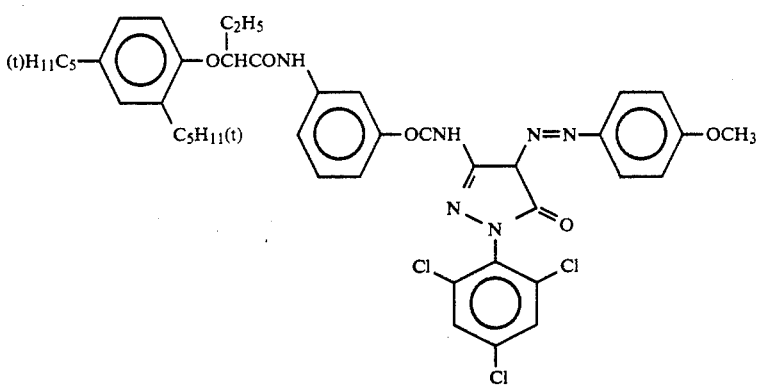

C-2

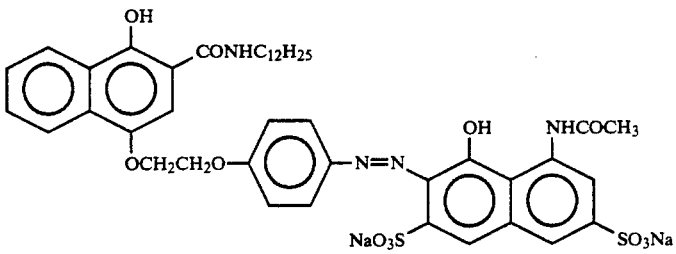

-continued
C-3
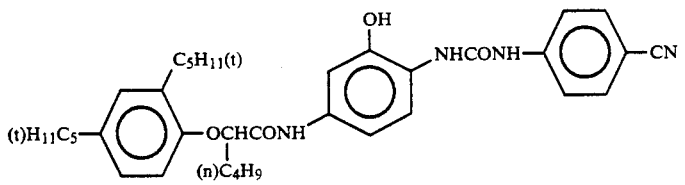
C-4
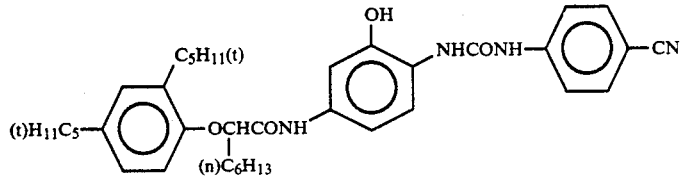
C-5
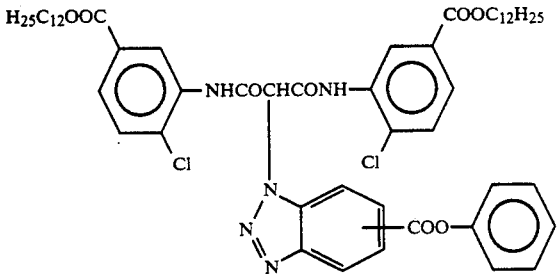
C-15
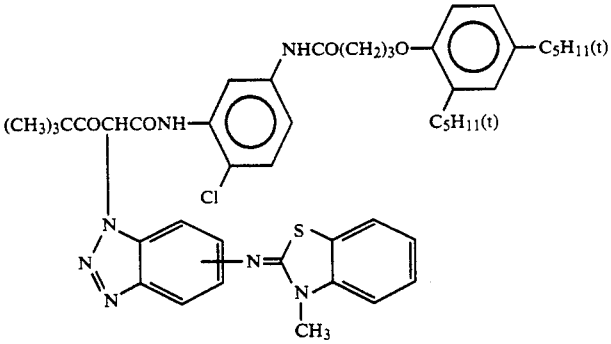
C-6
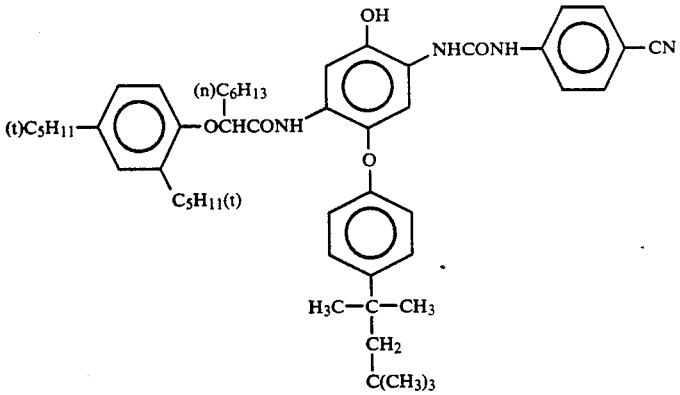
C-7
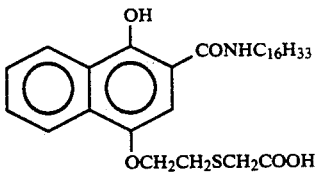

-continued
C-8
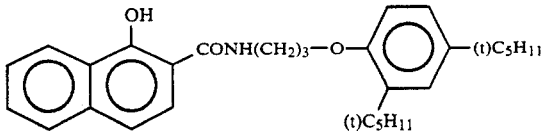
C-9
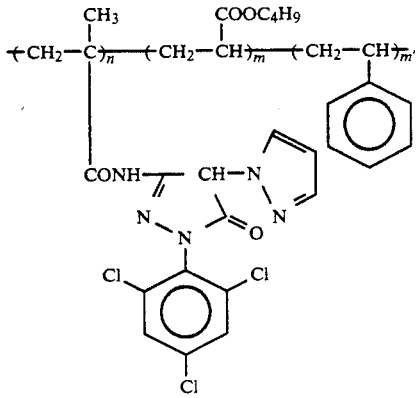
n = 50
m = 25 } wt. ratio
m' = 25
mol. wt. about 20,000
C-10
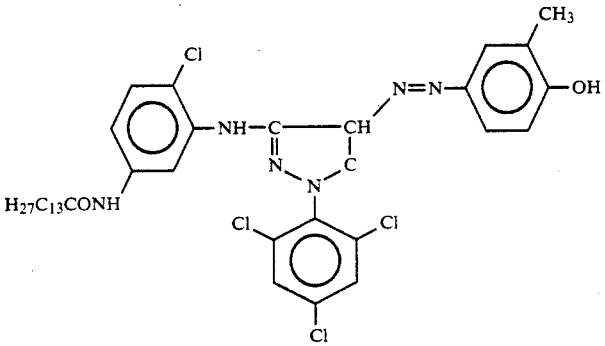
C-11
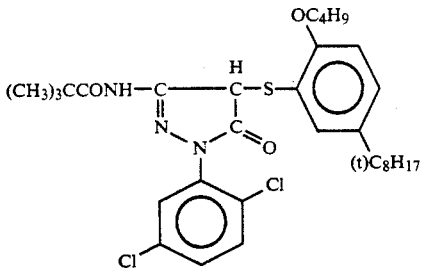
C-12
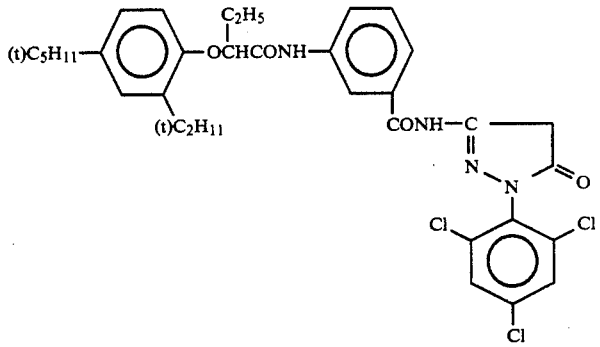

-continued
C-13
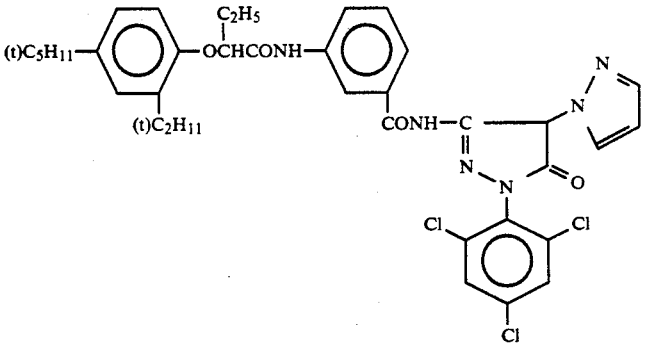
C-14
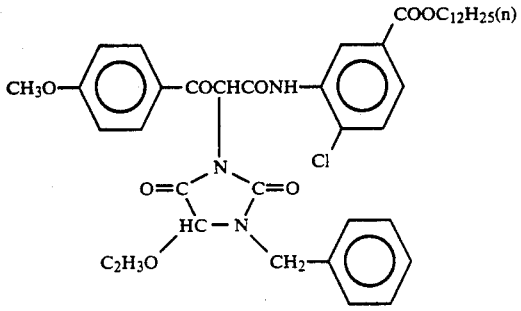
Cpd-A
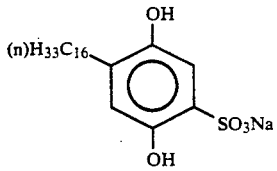
Cpd-B
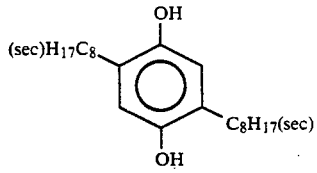
Sensitizing dye I
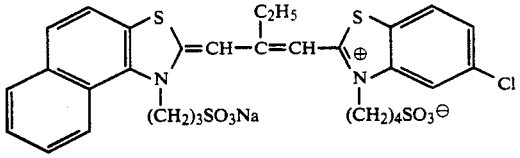
Sensitizing dye II
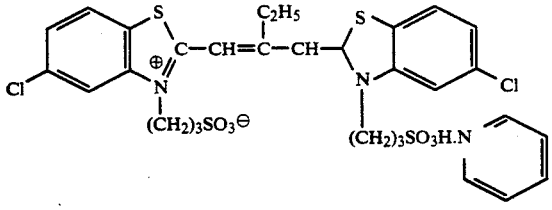
Sensitizing dye III
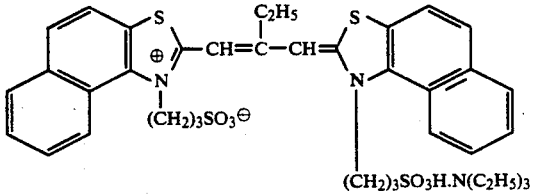

-continued
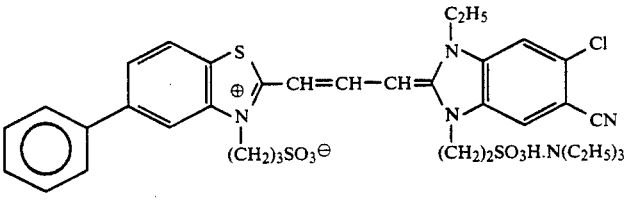
Sensitizing dye IV
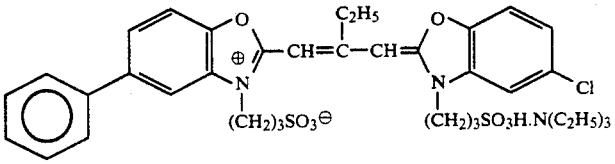
Sensitizing dye V
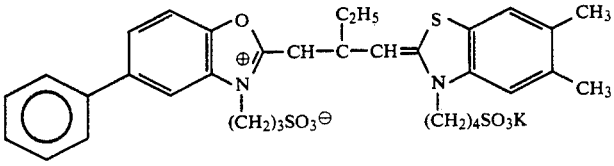
Sensitizing dye VI
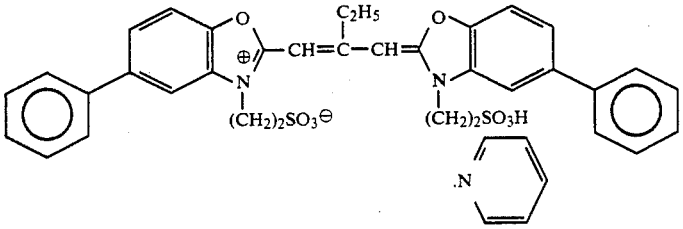
Sensitizing dye VII
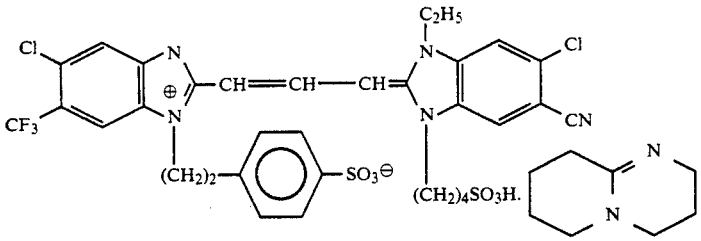
Sensitizing dye VIII
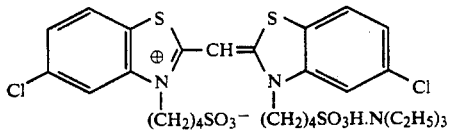
Sensitizing dye IX
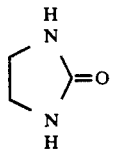
S-2
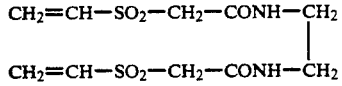
H-1
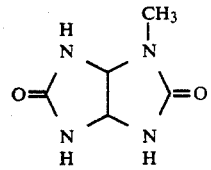
S-1

-continued

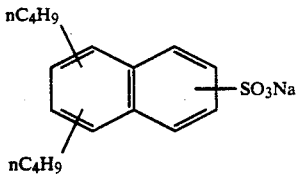

SA-1

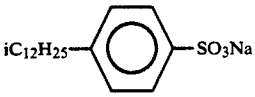

SA-2

$CH_3(CH_2)_{10}CH{=}CHCH_2SO_3Na$

SA-3

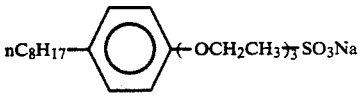

SA-4

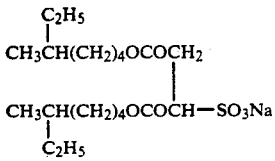

SA-5

$C_8F_{17}SO_2N(C_3H_7)CH_2COOK$

SA-6

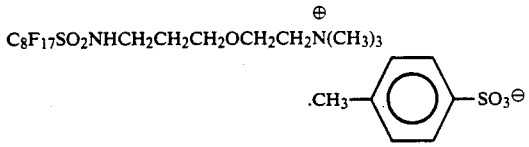

SA-7

Preparation of Sample 302

Sample 302 was prepared in the same manner as in the preparation of Sample 301 except that a fluorinated cationic surfactant SA-7 was used in place of the surfactant SA-6 (antistatic agent) used in the fourteenth layer of Sample 301.

Preparation of Sample 303

Sample 303 was prepared in the same manner as in the preparation of Sample 301 except that an equal amount (based on the combined amount of SA-4 and SA-5) of Compound 2 of the present invention was used in place of the surfactants SA-4 and SA-5 used in the fourteenth layer of the Sample 301.

Preparation of Sample 304

Sample 304 was prepared in the same manner as in the preparation of Sample 301 except that an equal amount (based on the combined amount of SA-4 and SA-5) of Compound 9 of the present invention was used in place of the surfactants SA-4 and SA-5 used in the fourteenth layer of Sample 301.

Multi-layer co coating was carried out with the thus-obtained coating solution having the above composition by means of the multi-slide process. The number of comets per $m^2$ formed on the coated sample was determined.

Subsequently, these photographic elements were subjected to exposure of 25 CMS (color temperature being adjusted to 4800° K. through a filter) by a tungsten light source, and then subjected to the following processing by an automatic processor.

TABLE 3

| Stage | Time | Temp. | Tank capacity | Replenishment rate (Note) |
|---|---|---|---|---|
| Color development | 3 min. 15 sec. | 38° C. | 18 l | 38 ml |
| Bleaching | 6 min. 30 sec. | 38° C. | 36 l | 18 ml |
| Fixing | 3 min. 15 sec. | 38° C. | 18 l | 33 ml |
| Rinse (1) | 1 min. 30 sec. | 38° C. | 9 l | — |
| Rinse (2) | 1 min. 30 sec. | 38° C. | 9 l | 1300 ml |
| Stabilization | 40 sec. | 38° C. | 9 l | 33 ml |

Note:
Replenishment rate being per 1 m long by 35 mm wide of photographic material.

In the above processing stage, a countercurrent rinsing system of from (2) to (1) was used.

The processing solutions had the following composition:

| | Mother Solution | Replenisher |
|---|---|---|
| Color developing solution | | |
| Diethylenetriamine-pentaacetic acid | 1.0 g | 1.0 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethyl-amino)-2-methylaniline sulfate | 4.5 g | 5.0 g |
| Water to make | 1 liter | 1 liter |
| PH | 10.00 | 10.05 |

-continued

| | Mother Solution | Replenisher |
|---|---|---|
| Bleaching solution | | |
| Ammonium ethylenediamine-tetraacetato ferrate | 100 g | 110 g |
| Disodium ethylenediamine-tetraacetate | 10.0 g | 11.0 g |
| Ammonia water | 7 ml | 5 ml |
| Ammonium nitrate | 10.0 g | 12.0 g |
| Ammonium bromide | 150 g | 170 g |
| Water to make | 1 liter | 1 liter |
| pH | 6.0 | 5.8 |
| Fixing solution | | |
| Disodium ethylenediamine-tetraacetate | 1.0 g | 1.2 g |
| Sodium sulfite | 4.0 g | 5.0 g |
| Sodium bisulfite | 4.6 g | 5.8 g |
| Aqueous solution of ammonium thiosulfate (70%) | 175 ml | 200 ml |
| Water to make | 1 liter | 1 liter |
| pH | 6.6 | 6.6 |
| Rinsing solution | | |
| Water was used. | | |
| Stabilizing solution | | |
| Formalin (37% w/v) | 2.0 ml | 3.0 ml |
| Polyoxyethylene p-monononyl-phenylether (average degree of polymerization: 10) | 0.3 g | 0.45 g |
| Water to make | 1 liter | 1 liter |

The above exposed color photographic materials (35 mm in width) were continuously processed by 20 m per day for 20 days by an automatic processor having a tank capacity give in Table 3.

The thus-processed samples were referred to as Samples-301-I to 304-I.

Separately, the exposed samples were continuously processed for 20 days in the same way as in the processing stage given in Table 3 except that the following rinsing solution was used in the rinsing (1) and (2) of Table 3 and the replenishment rate thereof was 27 ml. The thus-processed samples were referred to as Samples 301-II to 304-II.

| Rinsing solution B | Mother Solution | Replenisher |
|---|---|---|
| 2-Methyl-isothiazoline-3-one | 10 mg | 10 mg |
| 5-Chloro-2-methyliso-thiazoline-3-one | 10 mg | 10 mg |
| Water to make | 1 liter | 1 liter |
| pH (adjusted with sodium hydroxide) | 7.0 | 7.0 |

Each of the thus-processed samples was examined to determine whether a peeling static mark (fog caused by the spark of static electricity) was formed by rollers before processing. The formation of unevenness in density caused by processing was evaluated in four grades by the same criterion as that in Example 1. Further, the degree of the staining of the surfaces of the processed samples was evaluated according to the following three grades.

A: The deposition of staining was not found.

B: The deposition of staining was slightly found.

C: The deposition of staining was remarkably found.

These results are shown in Table 4.

TABLE 4

| Sample | Antistatic agent (14th layer) | Coating aid (14th layer) | Number of repellent spots (per $m^2$) | Processing test | Rinsing solution | Static mark | Unevenness in processing | Staining of surface |
|---|---|---|---|---|---|---|---|---|
| 301 (Comp. Ex.) | SA-6 | SA-4<br>SA-5 | 10 | I<br>II | water rinsing solution B | slightly formed | C | A<br>B |
| 302 (Comp. Ex.) | SA-7 | SA-4<br>SA-5 | 83 | I<br>II | water rinsing solution B | not formed | D | B<br>C |
| 303 (Invention) | SA-6 | Compound 2 | 1 | I<br>II | water rinsing solution B | slightly formed | A | A<br>A |
| 304 (Invention) | SA-7 | Compound 9 | 2 | I<br>II | water rinsing solution B | not formed | A | A<br>A |

It will be understood that when the compounds of the present invention are used, the number of comets formed is very small, and unevenness in processing and the staining of the surface are scarcely caused. Further, it is clear that when the antistatic agent SA-7 is used in combination with the compound of the present invention, the possibility of the formation of static mark can be eliminated.

It will be understood that the present invention has the following advantageous effects. (1) The hydrophilic colloid coating solutions containing the compounds of the present invention for forming the constituent layers of silver halide photographic materials have the advantages (i) that multi-layer co-coating can be uniformly carried out at a high speed without causing repellent spots and unevenness, and (ii) that thin films can be stably formed and coating can be conducted at a high speed in carrying out coating by the curtain coating system. (2) Photographic materials containing the compounds of the present invention do not cause the formation of staining materials in developing solutions.

While the present invention has been described in detail and with reference to specific embodiments thereof, it is apparent to one skilled in the art that various changes and modifications can be made therein without departing form the spirit and the scope of the present invention.

What is claimed is:

1. A silver halide photographic material comprising a support having thereon at least one light-sensitive silver halide emulsion layer, wherein said silver halide emulsion layer or another hydrophilic colloid layer contains a compound represented by the following general formula (I):

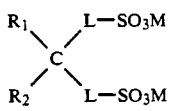

(I)

wherein $R_1$ and $R_2$ each represents a hydrogen atom or a substituted or unsubstituted hydrocarbon group having 1 to 30 carbon atoms, and at least one of $R_1$ and $R_2$ represents a substituted or unsubstituted hydrocarbon group including an alkyl group having not less than 6 carbon atoms; L represents

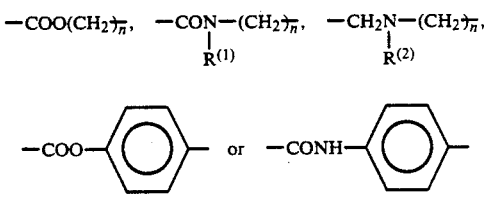

wherein $R^{(1)}$ represents a hydrogen atom or an alkyl group having 1 to 6 carbon atoms; $R^{(2)}$ represents a hydrogen atom, an alkyl group having 1 to 6 carbon atoms, or an acyl group; n is an integer of 1 to 6; and M represents a hydrogen atom or a cation.

2. The silver halide photographic material of claim 1, wherein $R_1$ and $R_2$ each separately represents an alkyl group having 6 to 10 carbon atoms which may be a straight-chain or branched alkyl group.

3. The silver halide photographic material of claim 1, wherein L represents

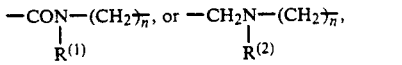

wherein $R^{(1)}$, $R^{(2)}$ and n are defined above.

4. The silver halide photographic material of claim 1, wherein the compound is represented by the following general formula (II):

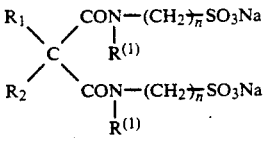

(II)

wherein $R_1$ and $R_2$ each separately represents an alkyl group having 6 to 10 carbon atoms; $R^{(1)}$ represents a hydrogen atom or an alkyl group having 1 to 6 carbon atoms; $R^{(2)}$ represents a hydrogen atom, an alkyl group having 1 to 6 carbon atoms or an acyl group; and n is an integer of 1 to 6.

5. The silver halide photographic material of claim 1, wherein the compound is represented by the following general formula (III):

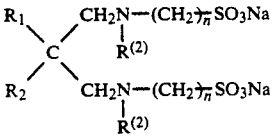

(III)

wherein $R_1$ and $R_2$ each separately represents an alkyl group having 6 to 10 carbon atoms; $R^{(1)}$ represents a hydrogen atom or an alkyl group having 1 to 6 carbon atoms; $R^{(2)}$ represents a hydrogen atom, an alkyl group having 1 to 6 carbon atoms or an acyl group; and n is an integer of 1 to 6.

6. The silver halide photographic material of claim 1, wherein the layer containing the compound according to formula (I) also contains a hydrophobic vinyl polymer.

7. The silver halide photographic material of claim 1, wherein the layer containing the compound according to formula (I) is the layer uppermost from the support.

8. The silver halide photographic material of claim 1, wherein the layer containing the compound according to formula (I) is the layer adjacent to the layer uppermost from the support.

* * * * *